United States Patent [19]

Harvey

[11] 4,071,801

[45] Jan. 31, 1978

[54] CROSSED-FIELD SWITCH DEVICE AND METHOD FOR OFF-SWITCHING

[75] Inventor: Robin J. Harvey, Thousand Oaks, Calif.

[73] Assignee: Hughes Aircraft Company, Culver City, Calif.

[21] Appl. No.: 749,125

[22] Filed: Dec. 9, 1976

[51] Int. Cl.[2] ..... H01J 1/50

[52] U.S. Cl. ..... 313/154; 313/157; 313/161

[58] Field of Search ..... 313/154, 157, 161

[56] References Cited

U.S. PATENT DOCUMENTS 3,405,300 10/1968 Wasa et al. ..... 313/154 X

*Primary Examiner*—James B. Mullins
*Assistant Examiner*—Darwin R. Hostetter
*Attorney, Agent, or Firm*—Allen A. Dicke, Jr.; W. H. MacAllister

[57] ABSTRACT

For off-switching, the magnetic field in a crossed-field switch device is modified by a localized auxiliary field to terminate the previously continuous closed electron path in the interelectrode space to terminate cascading ionization. The auxiliary field and its source can be much smaller in scope than the main field so that off-switching is quickly achieved.

9 Claims, 2 Drawing Figures

Fig. 1.
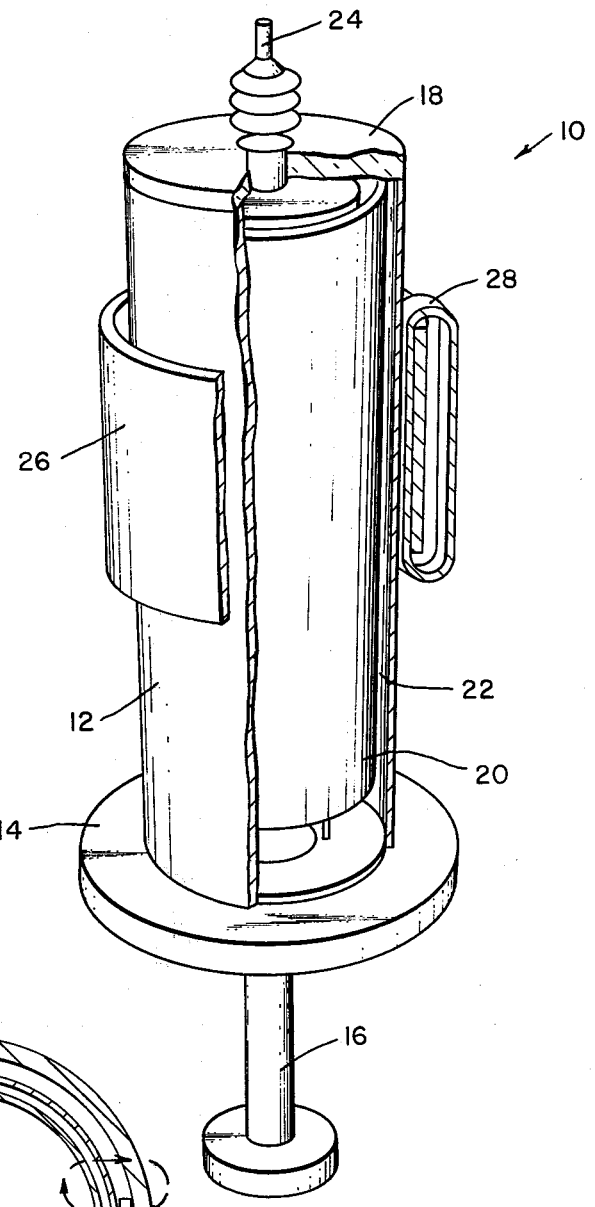
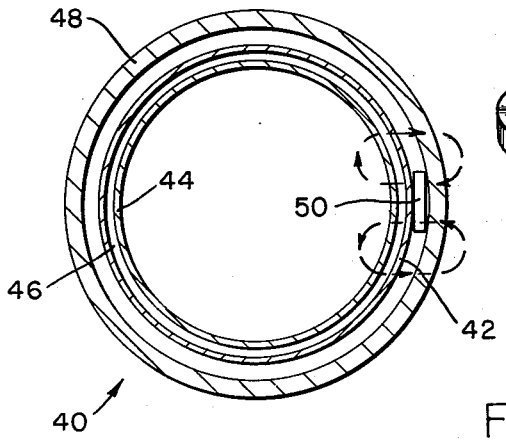
Fig. 2.

CROSSED-FIELD SWITCH DEVICE AND METHOD FOR OFF-SWITCHING

BACKGROUND OF THE INVENTION

This invention is directed to a crossed-field switch device, and particularly a crossed-field switch device which has a localized auxiliary magnetic field which can be turned on for off-switching.

A considerable amount of experimentation and development has been done by the research and development group with which the present inventor has been associated. The crossed-field switch device has been developed from a laboratory curiosity into an off-switching device which is capable of off-switching high current against high voltage. Prototype tubes have been developed which are capable of off-switching 10,000 amperes against 100 kilovolts without requiring a natural current zero for arc quenching. In general, these crossed-field switch devices comprise an inner anode surrounded by an outer cathode to define a continuous interelectrode space so that under the proper conditions an electron can orbit around the anode. Usually the anode and cathode electrodes are concentric cylinders so that an axis is defined. The electric field is radial, directly between the electrodes. A low pressure gas in the interelectrode space supports a glow discharge when the electron path is sufficiently long. The pressure is sufficiently low so that radial electron flow does not produce cascading ionization, but when an axial magnetic field is provided to the interelectrode space, the spiraling of electrons around the anode causes sufficient collisions to cause cascading ionizations. Interruption of the magnetic field causes collapse of the plasma and off-switching.

A group of the prior patents directed to the crossed-field switch device, and a number of its features include: Hofmann U.S. Pat. No. 3,558,960; Hofmann U.S. Pat. No. 3,604,977; Lutz et al U.S. Pat. No. 3,638,061; Lund et al U.S. Pat. No. 3,641,384; Lutz et al U.S. Pat. 3,678,289; Hofmann U.S. Pat. No. 3,714,510; Gallagher U.S. Pat. No. 3,749,978; Hofmann U.S. Pat. No. 3,769,537; Hofmann U.S. Pat. No. 3,873,871; Lutz et al U.S. Pat. No. 3,876,905; Lutz et al U.S. Pat. No. 3,890,520; Gallagher et al U.S. Pat. No. 3,906,270; Hofmann U.S. Pat. No. 3,947,342; and Gallagher et al U.S. Pat. No. 3,963,960. The disclosures of these patents are incorporated in their entirety into this specification.

A study of these patents shows that Lutz et al U.S. Pat. No. 3,678,289, Gallagher U.S. Pat. No. 3,749,978 and Hofmann U.S. Pat. No. 3,873,871 teach an off-switching magnetic field coil which at least pulses the main magnetic field below the critical value so that in the entire interelectrode space the magnetic field is below the critical value so that plasma collapse and off-switching occurs.

Gallagher et al, U.S. Pat. Nos. 3,963,960 and 3,906,270 discuss the arrangement of the magnetic field in the interelectrode space for conduction.

Thus, it has previously been taught that it is necessary that the magnetic field in the entire interelectrode space be pulsed below the critical value for the collapse of the plasma. Since the main field is quite strong, it requires a substantial magnetic pulse to bring the net field below the critical value and the result is considerable inductance in the field to cause difficulty in quickly reducing the main field.

SUMMARY

In order to aid in the understanding of this invention, it can be stated in essentially summary form that it is directed to a crossed-field switch device having anode and cathode electrodes defining an interelectrode space so that an electric field can be applied to the interelectrode space substantially normal to said electrodes. The interelectrode space is a closed path and has gas therein so that electrons can circulate along the closed path to cause cascading ionizing collisions. A magnetic field is applied normal to the electric field at substantially right angles to the electron path to maintain the elongated electron path. An anomaly producing auxiliary magnetic field can be applied into a small portion of the interelectrode space to interrupt the continuous electron path to prevent continuing cascading ionization, to quench the plasma and cause off-switching of the crossed-field switch device.

It is an object of this invention to provide a crossed-field switch device which can be off-switched without turning off the entire magnetic field to a value below the critical value. It is another object to provide an auxiliary magnetic field and a crossed-field switch device which produces a net magnetic field in the interelectrode space in just a portion of the space, along only a portion of the electron path. It is a further object to provide a crossed-field switch device which can be off-switched with less energy than by causing a net pulsing of the entire axial magnetic field below the critical value. It is a further object to provide off-switching which does not require losing the magnetic field energy stored in the axial magnetic field system when off-switching is required.

It is a further object to provide an on-switching cross-field switch device which has its magnetic field completed by adding a small portion of the magnetic field by an auxiliary magnetic field to close the electron trajectories.

It is a further object to provide an on and off-switching crossed-field device by first adding and then subtracting the auxiliary field.

Other objects and advantages of this invention will become apparent from a study of the following portion of this specification, the claims, and the attached drawings.

BRIEF DESCRIPTION OF THE DRAWINGS

FIG. 1 is a perspective view of a crossed-field switch device, with parts broken away and parts taken in section showing the auxiliary magnetic field coil in combination with the crossed-field switch device in accordance with this invention.

FIG. 2 is a transverse section through another crossed-field switch device showing another position of the auxiliary magnetic field coil for producing the off-switching field anomaly in accordance with this invention.

DESCRIPTION

Crossed-field switch device 10 in FIG. 1 has cylindrical tubular cathode 12 mounted on flange 14 which is supported on stand 16 which also serves as the cathode electrical connection. The top of the cathode is closed by insulator cap 18. In this way, the cathode, its flange and cap enclose a volume in which the gas pressure and character is controlled.

Cylindrical anode 20 is positioned within the cathode to define interelectrode space 22. The interelectrode space is annular around the axis of the anode and cathode. Anode 20 is supported under insulator cap 18 and is electrically connected therethrough by means of bushing and connector 24 which serves as the anode electrical connection.

Main magnetic field coil 26 provides a magnetic field in the interelectrode space. The magnetic field above the critical value for the applied voltage, spacing d and gas pressure, as is discussed in detail in the above-mentioned background patents. The electric field is radial in the interelectrode space and the magnetic field is axial, parallel to the central axis of the switch device. Under these circumstances, electrons spiral annularly around the interelectrode space and have a sufficiently long path that cascading ionization occurs so that the resultant plasma permits electrical conduction between the cathode and anode electrodes. It must be noted that the electron path must not intercept the anode in order to provide a sufficiently long electron path for continuing cascading ionization. In the present case, the path through the interelectrode space is a circular annulus at right angles to the tube axis. Circularity is not necessary, but continuity of the path is necessary.

In prior art structures, off-switching was achieved by reducing the net magnetic field in the entire interelectrode space below the critical value so that cascading ionization ceased. This was achieved either by off-switching main field coil 26 or providing an opposite magnetic pulse to bring the net value below the critical value.

Present operating limits of a modern crossed-field switching device are about 5 Kilo amperes at about 100 kilovolts. At lower ratings such a device is capable of off-switching at a rate of up to 120 hertz. When an extrapolation to higher currents or repetition rates is considered, the magnetic field pulsing requirements for off-switching by reducing the magnetic field in the entire interelectrode space below the critical value become more difficult to achieve. The eddy currents induced in the cathode wall and in other metallic tube components distort in both space and time the auxiliary off-switching field produced by the external magnetic field coil. A further complication is that the magnetic field energy stored in the interelectrode space is lost on each pulse.

Off-switching magnetic field coil 28 is positioned to produce a local or a small volume auxiliary magnetic field in one location in the interelectrode space so that the magnetic field above the critical value is not continuous all around the generally annular electron path. Off-switching magnetic field coil 28 is positioned to produce a tangential field of such magnitude and direction that electron paths in the interelectrode space below that coil are redirected so as to intercept the anode. This causes a loss of the electron trapping in the normal generally annular spiral electron path. Electrons are diverted from the annular path and are captured by the anode so that cascading ionization ceases.

Off-switching magnetic field coil 28 is positioned to embrace a portion of the main field coil and is oriented to produce a tangential auxiliary magnetic field. In a particular example, during conduction the main field coil produces an axial main field in the interelectrode space of 100 gauss. Superimposed upon that for off-switching is the magnetic field resulting from coil 28. The off-switching magnetic field is tangentially oriented and has a value of 100 gauss. Thus, with both coils turned on the net field in the interelectrode space is 141 gauss oriented at 45° to the axis. The electron paths are distorted by this net field so as to displace them in one direction along the axis or to cause them to strike the anode. Those that are displaced are eventually lost to the anode when they reach the end of coil 26. In this way off-switching is achieved with an auxiliary off-switching magnetic field coil.

The auxiliary magnetic field can be raised to the off-switching level in a time which is shorter than the main field and is determined by the decay of image currents which flow in the metalic cathode wall 12. This decay time (typically 10 microseconds) is proportional to the length of the auxiliary coil 28 whereas the equivalent decay time for the main field coil 26 (typically 50 microseconds) is proportional to its radius. The energy required by the auxiliary field (typically 0.2J) is proportional to its volume as is the energy required by the main field (typically 2J).

Crossed-field switch device 40 in FIG. 2 has the same basic characteristics. It has tubular cylindrical cathode 42 surrounding cylindrical anode 44 to define interelectrode space 46. Main magnetic field coil 48 produces an axial magnetic field, perpendicular to the drawing, in the interelectrode space. Under the conditions previously described, conduction takes place.

In crossed-field switch device 40 off-switching is accomplished by off-switching magnetic field coil 50. Coil 50 is a pancake coil and is shown as lying inside of main magnetic field coil 48 and outside of cathode 42. However, it can be placed anywhere that it can produce an adequate local magnetic field in the interelectrode space sufficient to interrupt the generally annular spiraling electron path. For example, it can be placed inside of anode 44 or it can be placed outside of main field coil 48. The disadvantage of placing it inside the anode is the fabrication problem and the problem of operatng it at a substantially different voltage level than the main field coil. The disadvantage of placing it on the outside of the main coil is that it needs to be of greater strength to accomplish the desired localized change in the net magnetic field value.

Crossed-field switch device 40 is an elongated tubular structure the same as the crossed-field switch device 10 and main field coil 48 is an elongated tubular structure similar to main field coil 26, to produce the desired axial magnetic field along the entire axial length of the interelectrode space. Thus, off-switching magnetic field coil 50 is also elongated in the direction perpendicular to the drawing so that it extends in the axial direction of crossed-field switch device 40 substantially the same length as main field coil 48. Thus, when only main field coil 48 is on there is sufficient axial field to cause an annular spiraling electron path for cascading ionization. However, when off-switching magnetic field coil 50 is also turned on, the net value of the field in the interelectrode space immediately below coil 50 prevents annular electron motion and permits the electrons to be captured by the anode and thus cease the cascading ionization. In this way, the crossed-field switch device is turned off.

The principal preferred embodiment provides a local auxiliary magnetic field which when turned on produces a local anomoly in the otherwise substantially uniform main magnetic field. It is understood that the main and auxiliary magnetic fields can cooperate in another way. When both are turned on, the net field is uniform but the auxiliary field is turned off, a local magnetic field anomoly is used to cause electrons to intercept the anode without sufficient ionizing collisions to cause cascading ionization and conduction.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A crossed-field switch device comprising:

an anode electrode;

a cathode electrode spaced from said anode electrode and defining an interelectrode space therebetween so that an electric potential can be applied between said electrodes to define an electric field across said interelectrode space, said interelectrode space being a continuous closed path and being arranged to contain a selected gas under a selected pressure;

main magnetic field means for producing a magnetic field in the interelectrode space at an angle with respect to the electric field and at an angle with respect to the continuous closed path in the interelectrode space so that in the presence of the main magnetic field and the electric field electrons are caused to spiral through the interelectrode space in a sufficiently long closed path before intercepting the anode to cause cascading ionizing collisions to cause electric conduction between said electrodes, the improvement comprising:

auxiliary magnetic field means positioned with respect to said interelectrode space for causing a net distorted portion of the magnetic field in only a portion of the interelectrode space in the closed path direction so that the distorted portion prevents continuity of the closed electron path to terminate cascading ionizing collisions to cause off-switching of the device.

2. A crossed-field switch device comprising:

an anode electrode;

a cathode electrode spaced from said anode electrode and defining an interelectrode space therebetween so that an electric potential can be applied between said electrodes to define an electric field across said interelectrode space, said interelectrode space being a continuous closed path and being arranged to contain a selected gas under a selected pressure;

main magnetic field means for producing a magnetic field in the interelectrode space at an angle with respect to the electric field and at an angle with respect to the continuous closed path in the interelectrode space so that in the presence of the main magnetic field and the electric field electrons are caused to spiral through the interelectrode space in a sufficiently long closed path before intercepting the anode to cause cascading ionizing collisions to cause electric conduction between said electrodes, the improvement comprising:

auxiliary magnetic field means positioned with respect to said interelectrode space for causing a net distorted portion of the magnetic field in only a portion of the interelectrode space in the closed path direction, said auxiliary magnetic field means including an auxiliary magnetic field coil, said auxiliary magnetic field coil being positioned adjacent the interelectrode space so that the coil extends in a direction generally parallel to the field direction of the main magnetic field to produce an auxiliary magnetic field at substantially right angles to the main magnetic field so that the thus distorted portion of the magnetic field prevents continuity of the closed electron path to terminate cascading ionizing collisions to cause off-switching of the device.

3. The crossed-field switch device of claim 2 wherein said auxiliary magnetic field coil is positioned to produce an off-switching auxiliary magnetic field which is substantially parallel to the path of electrons spiraling on the closed path.

4. The crossed-field switch device of claim 2 wherein said auxiliary magnetic field coil is positioned to produce a magnetic field substantially parallel to said electric field, normal to said electrodes.

5. A crossed-field switch device comprising:

a tubular cathode electrode, an anode positioned within said cathode and spaced therefrom to define an interelectrode space therebetween so that an electric potential can be applied between said electrodes to define an electric field across said interelectrode space, said interelectrode space being a continuous closed path and being arranged to contain a selected gas under a selected pressure, said device having an axis parallel to said electrodes;

main magnetic field means for producing a magnetic field in the interelectrode space at an angle with respect to the electric field and at an angle with respect to the continuous closed path in the interelectrode space so that in the presence of the main magnetic field and the electric field the electrons are caused to spiral through the interelectrode space in a sufficiently long closed path before intercepting the anode to cause cascading ionizing collisions to cause electric conduction between said electrodes, the improvement comprising:

an auxiliary magnetic field coil positioned substantially parallel to said axis and positioned with respect to said interelectrode space for causing a net distorted portion of the magnetic field in only a portion of the interelectrode space in the closed path direction so that the distorted portion prevents continuity of the closed electron path to terminate cascading ionizing collision to cause off-switching of the device.

6. The crossed-field switch device of claim 5 wherein said auxiliary magnetic field coil embraces said main field coil.

7. The crossed-field switch device of claim 5 wherein said auxiliary magnetic field coil is positioned within said main magnetic field coil.

8. The method of operating a crossed-field switch device comprising:

applying an electric field to the interelectrode space between spaced electrodes which has a continuous closed electron path and has a controlled gas environment;

applying a magnetic field to the interelectrode space over the entire closed path region thereof so that electrons spiral along the closed path to provide cascading ionization to cause conduction between said electrodes, the improvement comprising:

changing a localized auxiliary magnetic field in only a portion of the closed electron path to interrupt the closed electron path to prevent sufficient collisions to cause cascading ionization to cause off-switching of said crossed-field switch device.

9. A crossed-field switch device comprising:

an anode electrode;

a cathode electrode spaced from said anode electrode and defining an interelectrode space therebetween so that an electric potential can be applied between said electrodes to define an electric field across said interelectrode space, said interelectrode space being a continuous closed path and being arranged to contain a selected gas under a selected pressure;

magnetic field means for producing a magnetic field in the interelectric space at an angle with respect to the electric field and at an angle with respect to the continuous closed path in the interelectrode space, the improvement comprising:

said magnetic field means including main magnetic field means and auxiliary magnetic field means for cooperating together in one mode to provide a magnetic field above a critical value in the continuous closed path to cause electrons to spiral through the interelectrode space without intercepting said anode electrode to cause cascading ionizing collisions to cause electric conduction between said electrodes and for cooperating together in another mode where the state of the auxiliary magnetic field is changed from the first mode to provide a magnetic field which is below the critical value in only a portion of the path of the continuous closed path to cause redirection of electron paths in the region of the auxiliary magnetic field so that electrons intercept the anode and cascading ionization ceases to terminate conduction.

* * * * *